US005103652A

United States Patent [19]

Mizuno et al.

[11] Patent Number: 5,103,652

[45] Date of Patent: Apr. 14, 1992

[54] SCROLL COMPRESSOR AND SCROLL-TYPE REFRIGERATOR

[75] Inventors: Takao Mizuno; Naomi Hagita; Kimio Nagata, all of Shimizu; Atushi Amata, Shizuoka, all of Japan

[73] Assignee: Hitachi, Ltd., Tokyo, Japan

[21] Appl. No.: 600,722

[22] Filed: Oct. 22, 1990

[30] Foreign Application Priority Data

Oct. 30, 1989 [JP] Japan ..... 1-282198

[51] Int. Cl.[5] ..... F25B 31/00

[52] U.S. Cl. ..... 62/505; 418/97

[58] Field of Search ..... 62/505, 510; 418/97

[56] References Cited

U.S. PATENT DOCUMENTS 4,648,814 3/1987 Shiibayashi ..... 418/97 X 4,748,831 6/1988 Shaw ..... 62/505

FOREIGN PATENT DOCUMENTS 49-54943 9/1972 Japan .

57-76289 5/1982 Japan .

*Primary Examiner*—William E. Wayner

*Attorney, Agent, or Firm*—Antonelli, Terry, Stout & Kraus

[57] ABSTRACT

In a scroll compressor having a stationary scroll and a revolving scroll, and a refrigerator incorporating this scroll compressor, the stationary scroll has a gas suction hole formed in its radially outer portion, a gas discharge hole formed in its central portion, and gas injection holes and a liquid injection hole formed between the suction and discharge holes. The gas injection holes are formed in a radially outer portion of the stationary scroll, and the liquid injection hole are formed in a central portion of the stationary scroll. The refrigerator incorporates the scroll compressor, a condenser, decompressors and an evaporator to form a refrigerating circuit. The liquid injection hole of the scroll compressor is directly connected by piping to the outlet of the condenser, and the gas injection holes are connected by piping to the outlet of the condenser through one of the decompressors. Even though the compressor is a single-stage compressor having one compression unit and one electric motor unit, the reduction in the volumetric efficiency can be limited and the power necessary for compression during practical use is substantially the same as the power for the two-stage compression type. Consequently, the compressor of the invention has substantially the same compressor efficiency as the conventional two-stage compressor at evaporation temperatures of −45° to −70° C.

14 Claims, 5 Drawing Sheets

SCROLL COMPRESSOR AND SCROLL-TYPE REFRIGERATOR

BACKGROUND OF THE INVENTION

This invention relates to a scroll compressor and a refrigerator incorporating the scroll compressor and, more particularly, to a scroll type refrigerator capable of operating efficiently at low temperatures.

In low-temperature refrigerators, as is well known, the suction pressure is reduced if the evaporation temperature decreases. The compression ratio is accordingly increased and the volumetric efficiency of the compressor is thereby reduced so that the refrigerating capacity becomes smaller. The compression efficiency is also reduced, the desired power is increased and the temperature of the discharged gas becomes considerably high. As a result, the lubricating oil deteriorates and, in the case of a sealed type compressor, there is the problem of deterioration in the insulating properties of the incorporated electric motor.

A two-stage compression system has therefore been adopted in which the compressing process is divided into two stages to compensate for these drawbacks at evaporation temperatures of −45° to −70° C., at which the tendency to such a result is marked. Coventionally, a volume type compressor such as a reciprocating compressor or a screw compressor is used as a two-stage compressor constituting such a two-stage compression system. A two stage compression-one stage expansion type refrigerator is used as a typical two-stage compression system.

The two-stage compression-one stage expansion cycle is also applied to refrigeration in the range of evaporation temperatures ordinarily attainable by single-stage compression, because the refrigerating capacity of this cycle can be increased by supercooling of high-pressure refrigerant liquid to increase the coefficient of performance. For example, Japanese Patent Unexamined Publication No. 49-54943 discloses a refrigerator in which the gas is injected during compression by using a screw compressor so that the high-pressure refrigerant liquid is supercooled by the effect of this injection. Also, Japanese Patent Unexamined Publication No. 57-76289 discloses a refrigerator using a scroll compressor, wherein gas injection is effected for energy saving and for increasing the capacity at the time of cooling and heating.

If a two-stage compressor is used, low temperatures of −45° to −70° C. can be obtained but the two-stage compressor requires two sets of compression mechanism units and motor units for driving the compression mechanism or the mechanism for two-stage compression must be complicated, resulting in an increase in manufacture cost. Two-stage compressor is not practically applicable to small-capacity refrigerators because of the problem of its complicated mechanism and the increase in manufacture cost.

On the other hand, it can be presupposed that screw or scroll compressors can be realized which are capable of operating at a high volumetric efficiency and at a high compression efficiency even when the compression ratio is high because, in screw or scroll compressors, the compressed gas leakage thereof during compression is small even under a high compression ratio condition as can be understood from the compression principle of these compressors. However, screw or scroll compressors have not been put to practical use for the reasons described below. Details of a geometrical theory relating to the theory of compression using a scroll compressor have been reported in "Geometrical Theory of Scroll Compressors" by Morishita et al., Turbo Machine (Turbo Kikai) No. 4, Volume 13, April, 1985. In this report are described the relationship between the theoretical built-in volume ratio (hereinafter referred to as "set volume ratio") and the number of turns of the voluted body (hereinafter referred to as "wrap"), the set volume ratio, the optimum compression ratio, and unnecessary power consumed when the operating condition deviates from the optimum compression ratio. In the case of a scroll compressor, the set volume ratio is determined from the compression ratio at which the scroll compressor ordinarily operates and from the geometric theory of the scroll compressor so that the optimum compression ratio is closer to the compression ratio at which the compressor ordinarily operates.

It can be theoretically presupposed that scroll compressors are suitable for a high compression ratio compressor from the fact that in scroll compressors the confining capacity can be 100% compressed for discharge in theory, and the fact that some intermediate compression chambers are formed during the period between suction and discharge and that the number of intermediate chambers is increased as the set volume capacity is increased so that the leakage of the compressed fluid becomes smaller. However, in a case where a scroll compressor is designed for a refrigerator operating at evaporation temperatures of −45° to −70° C. with Freon 22 used as a refrigerant, and if the condensation temperature is 40° C., the compression ratio is about 20 when the evaporation temperature is −45° C., or is about 75 when the evaporation temperature is −75° C. To set the optimum compression ratio in this range, it is necessary to select a set volume ratio in a range of 12 to 38. If the geometrical shape of the laps is determined from a set volume ratio of 25 which is the mean value of the range of 12 to 38, the number of wrap turns is about 20.

This number is 5 to 10 times larger than the number of lap turns in the conventional scroll compressors put to practical use, which is about 2 to 4. In this case, the overall size of the compressor is very large, as can be understood from the fact that the outside size of the voluted body is generally proportional to the number of turns thereof. The mass production technique for working such a large voluted body with accuracy must be improved to a very high level.

Thus, it is not possible to obtain low temperatures determined by evaporation temperatures of −45° to −70° C. by using scroll compressors in practice. For these reasons, two-stage compression type compressors have conventionally been used.

SUMMARY OF THE INVENTION

It is therefore an object of the present invention to provide a compressor and a refrigerator incorporating this compressor in which the reduction in the volumetric efficiency is small and the power required for compression during practical use is substantially the same as that for the two-stage compression type compressor although the compressor of the invention is a single stage compressor consisting of one set of a compression unit and an electric motor unit.

This object of the present invention can be achieved by improving the scroll compressor. That is, according to the present invention, there is provided a scroll compressor having a stationary scroll and a revolving scroll and having a gas suction hole and a gas discharge hole. A gas injection hole and a liquid injection hole are formed between the gas suction hole and the gas discharge hole. According to the present invention, there is also provided a refrigerator incorporating this scroll compressor, a condenser, decompressors and an evaporator to form a refrigerating circuit. In this refrigerator, the outlet of the condenser is directly connected by piping to the liquid injection hole of the scroll compressor, and is also connected by piping to the gas injection hole through one of the decompressors.

The scroll compressor of the present invention thus constructed operates in the same manner as the conventional scroll compressor if the gas injection hole and the liquid injection hole are closed, for example.

If the scroll compressor constructed as described above is combined with refrigerating circuit components including the condenser to form a refrigerating circuit by directly connecting through a piping the outlet of the condenser to the liquid injection hole of the scroll compressor and by connecting through a piping the decompressor to the gas injection hole, the scroll compressor operates as a low-temperature single-stage compressor at evaporation temperatures of −45° to −70° C. when this refrigerating circuit is operated. It is thereby possible to effect supercooling of high-pressure liquid refrigerant and to increase the refrigerating capacity and, hence, the coefficient of performance. Ordinarily, in scroll compressors, the confining capacity, in theory, can be 100% compressed for discharge, but the volumetric efficiency is smaller than the theoretical value in actual machines. In the case of a low-temperature scroll compressor having evaporation temperatures of −45° to −70° C., the greatest cause for the reduction in the volumetric efficiency is the loss due to heating of drawn gas. According to the present invention, however, the drawn gas is cooled by liquid injection so that heating in the inlet chamber is prevented. Accordingly, the volumetric efficiency is not reduced.

If a liquid injection cooling system is used in which injection of high-pressure liquid refrigerant is effected during compression, the required power is ordinarily increased. According to the present invention, however, refrigerant gas is injected through the gas injection hole, so that the power is not increased. Also, according to the present invention, the liquid injection hole is formed in the vicinity of the discharge hole and non-decompressed refrigerant liquid is introduced through this hole. The recompressing power of the liquid injection refrigerant is therefore small and the power required for the compressor is not increased although the discharge gas temperature can be reduced.

BRIEF DESCRIPTION OF THE DRAWINGS

FIGS. 1 to 7 show embodiments of the present invention, wherein:

FIG. 1 is a schematic diagram of the refrigerating circuit of a refrigerator;

FIG. 2 is a diagram of the refrigerating cycle of the refrigerator shown in FIG. 1;

FIG. 3 is a cross-sectional view of a scroll compressor in accordance with the present invention;

FIG. 5 is a diagram of a state in which a maximum closed space is defined by the combination of the stationary scroll and the revolving scroll;

FIG. 6 is a schematic diagram of another example of the refrigerator and

FIG. 7 is a diagram of the refrigerating cycle of the refrigerator shown in FIG. 6.

DESCRIPTION OF THE PREFERRED EMBODIMENTS

An embodiment of the present invention will be described below with reference to FIGS. 1 to 5.

Figure 1:
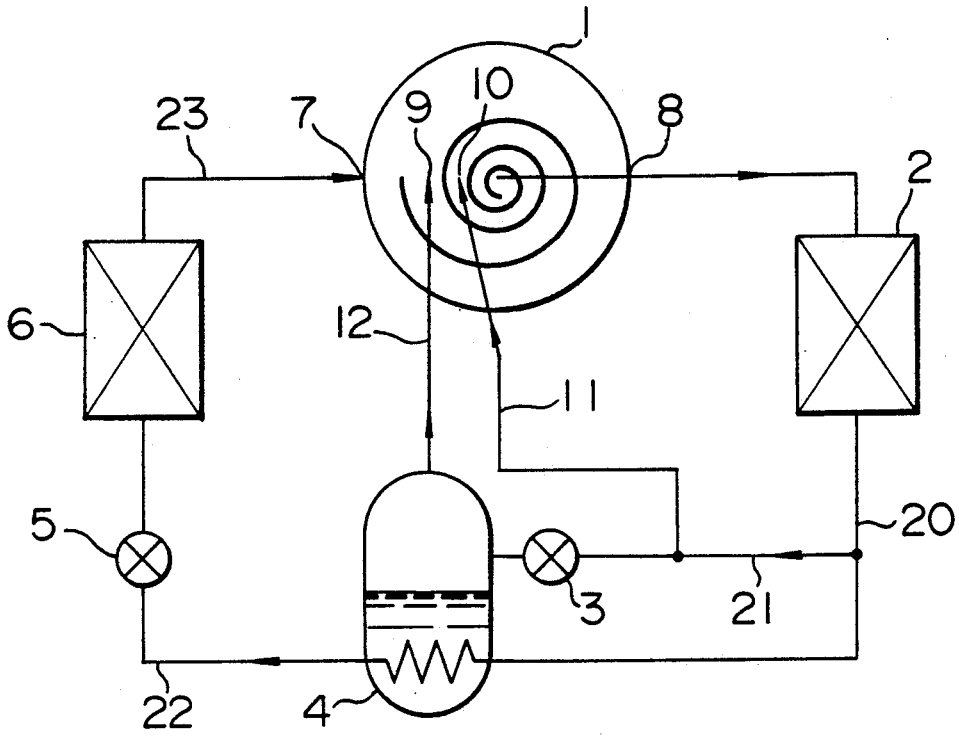
Figure 2:
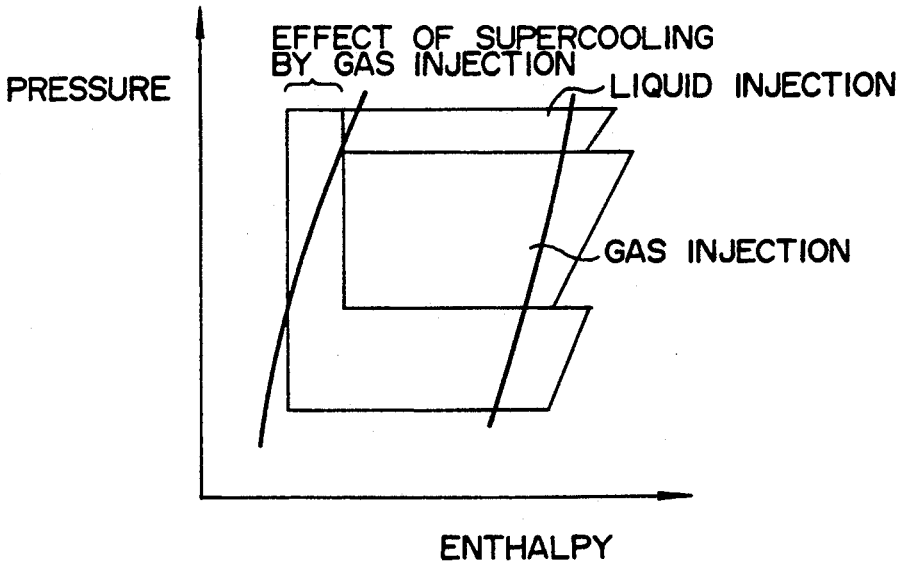

FIG. 1 shows the construction of a refrigerating circuit of a scroll refrigerator capable of operating at evaporation temperatures of −45° to −70° C. in accordance with the embodiment of the present invention. As shown in FIG. 1, a compressor 1 of a scroll type has a refrigerant inlet 7, a refrigerant outlet 8, a gas injection port 9 and a liquid injection port 10. A flow rate control valve is provided at each injection port if necessary. A branch pipe 21 diverges from a pipe 20 connected to a condenser 2. A first decompressor 3 is connected to the branch pipe 21 between the condenser 2 and a liquid cooler 4 provided as a high pressure liquid supercooling device. A liquid injection pipe 11 diverges from the branch pipe 21 between the first decompressor 3 and the condenser 2. The liquid injection pipe 11 communicates with the liquid injection port 10 of the scroll compressor 1. A gas injection pipe 12 for leading the refrigerant gas decompressed by the first decompressor 3 to the gas injection port 9 of the scroll compressor 1 is connected to the liquid cooler 4. The refrigerator has pipe passages 22 and 23. The pipe passage 22 extends from the condenser 2, passes through the liquid cooler 4, and is connected to an evaporator 6 through a second decompressor 5 which is provided as a main decompressing device of the refrigerating circuit. The pipe passage 23 connects the evaporator 6 and the scroll compressor 1. FIG. 2 shows the refrigerating cycle of the refrigerator of FIG. 1.

Figure 3:
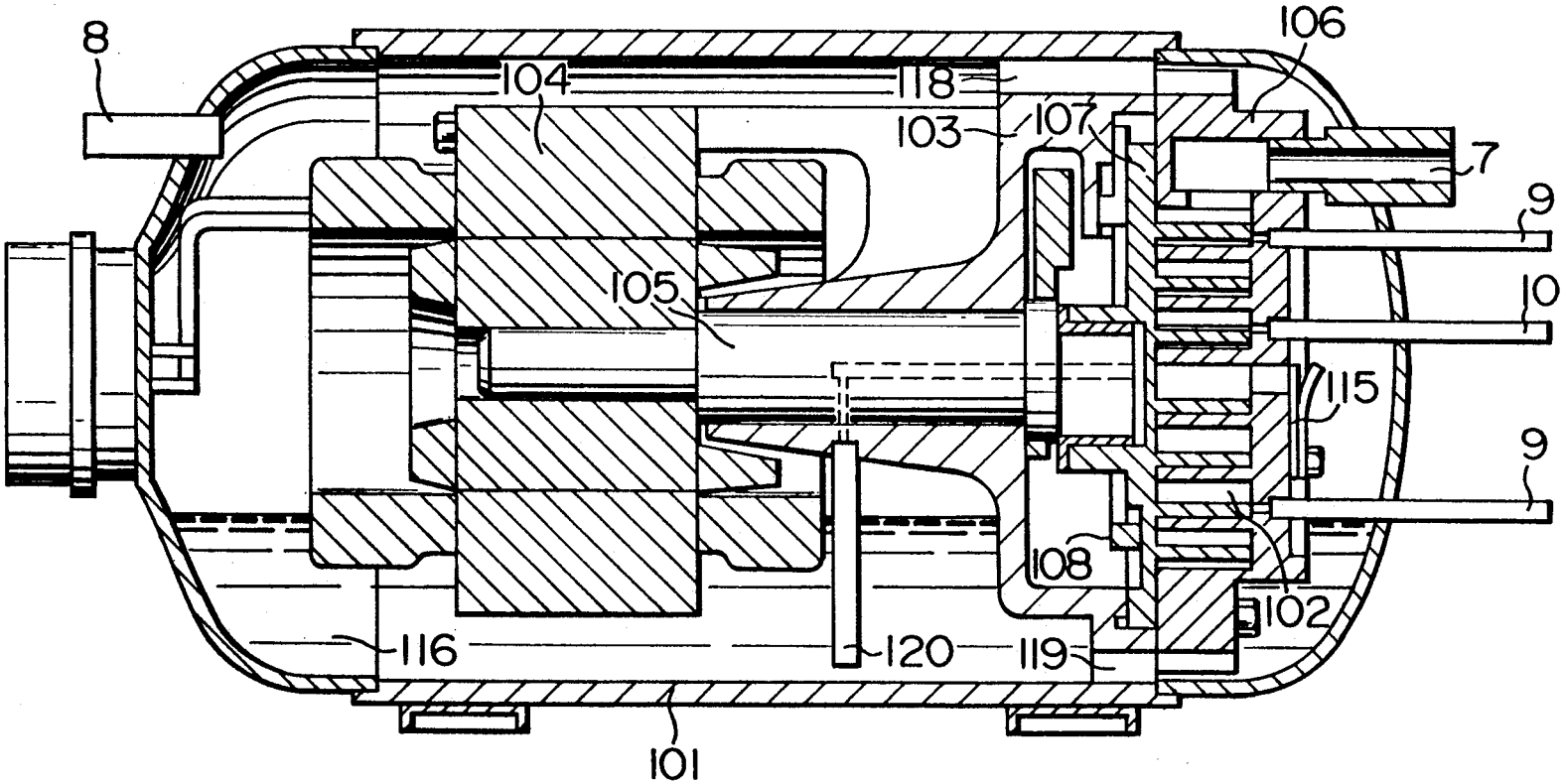

FIG. 3 shows in section an example of the scroll compressor in accordance with this embodiment. The scroll compressor shown in FIG. 3 has a sealed casing 101 to which an outlet pressure is applied and in which a compression section 102, a frame 103, an electric motor 104, a crankshaft 105 and other members are housed. The compression section 102 is constructed by a stationary scroll 106 and a revolving scroll 107. The revolving scroll 107 has a bearing portion formed on the side remote from the compression section and engaged with a crankshaft 105. An Oldham's ring 108 prevents the revolving scroll 107 from rotating.

Figure 4B:
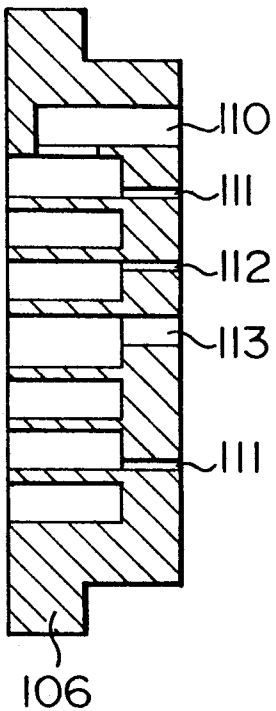
FIGS. 4*a* and 4*b* are a plan view and a side view, respectively, of the stationary scroll of the scroll compressor shown in FIG. 3.
Figure 4A:
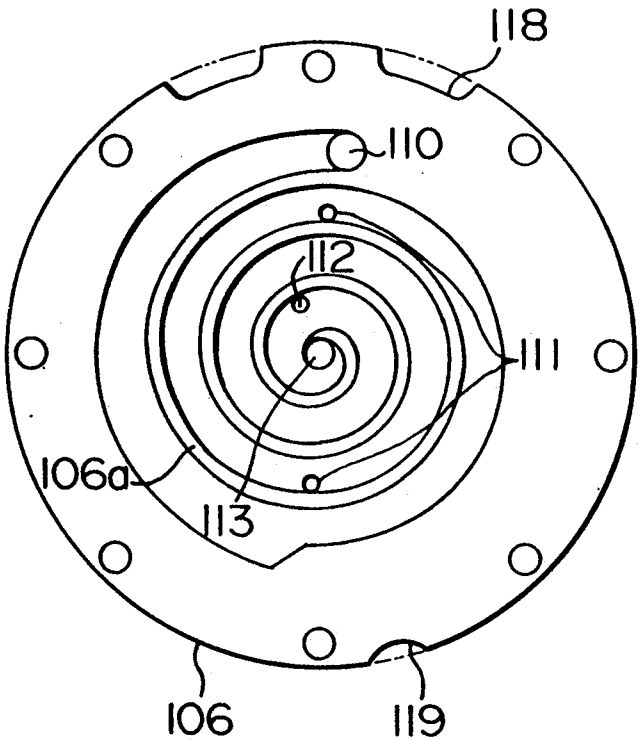

FIGS. 4*a* and 4*b* show the stationary scroll 106 of the scroll compressor shown in FIG. 3. The stationary scroll 106 has, as illustrated, a suction hole 110 communicating with the inlet 7, two gas injection holes 111 communicating with the gas injection port 9, a liquid injection hole 112 communicating with the liquid injection port 10, and a gas discharge hole 113. The diameters of the injection holes 111 and 112 are smaller than the thickness of a wrap 107*a* of the revolving scroll 107, and these holes are formed along surfaces of a wrap 106*a* as also shown in FIG. 4*b*. The gas suction hole 110 is formed in a portion of the stationary scroll 106 closer to the radial outer end thereof. The gas discharge hole 113 is formed in an inner portion, i.e., a central portion of the stationary scroll. The gas injection holes 111 and the liquid injection hole 112 are formed between the gas suction hole 110 and the gas discharge hole 113. The positions of these holes are determined relative to each other so as to avoid any interference between them, as shown in FIG. 4*a*.

The lap 106*a* of the stationary scroll is defined by an involute curve and has about four turns in this embodiment, so that if Freon 22 is used as the fluid to be compressed, the optimum compression ratio is 5 and the set volume ratio is 3.9. The geometrical shape of the wrap is thus set. The suction hole 110, the gas injection holes 111 and the liquid injection hole 112 can therefore be positioned so that they do not substantially communicate with each other during the period between suction and discharge in the range of the numbers of wrap turns of scroll compressors put to practical use. Also, because of the above-described shape of the lap, the size of the compressor can be reduced.

Figure 5:
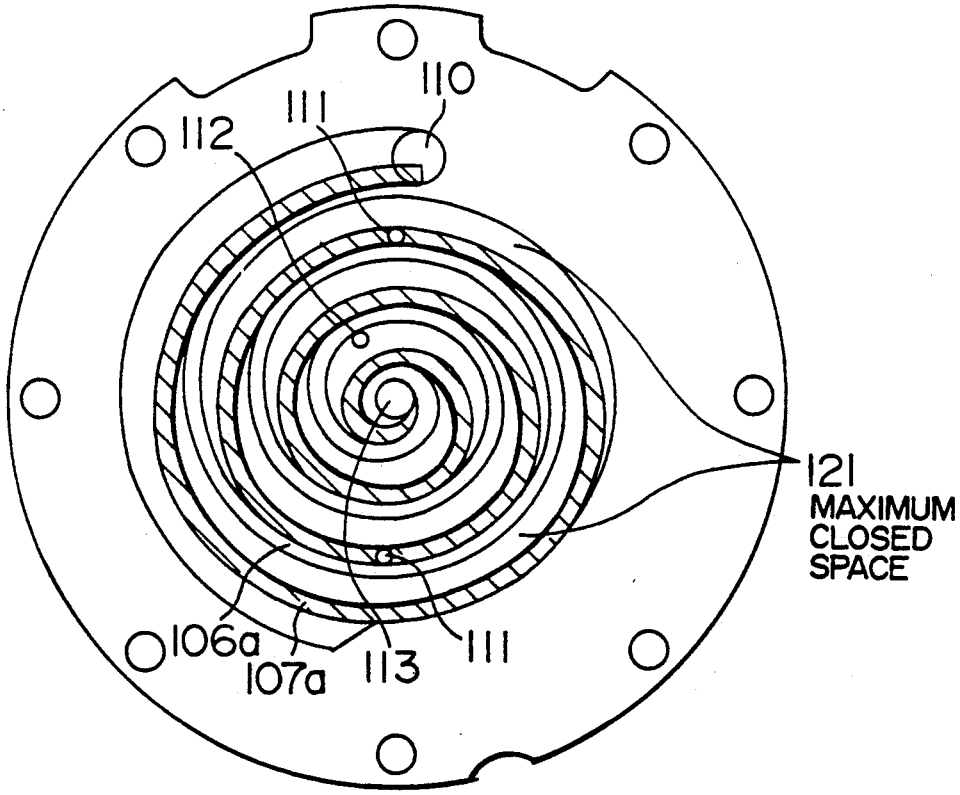

FIG. 5 shows a state where the stationary scroll 106 and the revolving scroll 107 are combined and in which a gas is drawn into the space defined therebetween. In this state, the two gas injection holes 111 are closed by the lap 107*a* of the revolving scroll.

As shown in FIG. 3, a discharge valve (check valve) 115 is provided at the discharge hole 113 of the stationary scroll. The valve 115 serves to prevent unnecessary consumption of the power of the compressor. Lubricating oil 116 is accumulated at the bottom of the sealed casing 101 and is used to lubricate slide surfaces by being supplied through an oil supply pipe 120 connected to the frame 103. The frame 103 is fixed to the sealed casing 101. A gas passage 118 and a lubricating oil passage 119 are formed in the frame 103 and the stationary scroll 106 so as to provide a communication between the space on the stationary scroll 106 side and the space on the electric motor 104 side.

The operation of this embodiment will now be described below. First, the operation of the scroll compressor shown in FIG. 3 is described below. The gas drawn and led to the inlet 7 of the scroll compressor is directly led to the suction hole 110 of the stationary scroll 106. The drawn gas is introduced into an outer peripheral inlet chamber defined by the stationary scroll 106 and the revolving scroll 107 by the revolving motion of the revolving scroll 107, which is revolved relative to the stationary scroll 106 by the electric motor 104 and the crankshaft 105 while being prevented by the Oldham's ring 108 from rotating. The drawn gas is then confined in a maximum closed space 121 (FIG. 5). Before the formation of this maximum closed space 121 is completed, the inlet chamber space and the gas injection holes 111 do not substantially communicate with each other according to the positional relationship therebetween. Therefore the suction is not influenced by the gas injection and the flow rate of the drawn gas is not reduced. After being confined in the maximum closed space, the drawn gas is compressed as the closed space is moved toward the center by the movement of the revolving scroll 107 so that the volume of the space is reduced. In this embodiment, immediately after the maximum closed space 121 is formed, the gas injection holes 111 and the closed space (not shown) communicate with each other to inject the refrigerant gas into the closed space. The drawn refrigerant gas and the injected refrigerant gas are compressed together toward the center. After the gas injection holes 111 have been substantially separated from the compression space, and at a point in time close to the end of the compression process, the liquid injection hole 112 and the compression space communicate with each other and the refrigerant liquid is injected. The refrigerant gas which is being compressed is cooled by the latent heat of the liquid refrigerant and is thereafter discharged through the discharge hole 113 at the center of the stationary scroll 106. In this embodiment, the optimum compression ratio is 5 and, under the operating condition, i.e. at evaporation temperatures of −45° to −70° C., the effect of compression in the closed space formed by the wraps is insufficient and surplus power is needed with respect to theoretical compressing power. The discharge valve 115 is provided to reduce the surplus power generated.

The refrigerant gas discharged through the discharge hole 113, i.e., the refrigerant gas drawn through the suction hole 110, the refrigerant gas injected through the gas injection holes 111 and the refrigerant injected through the liquid injection hole 112 pass through the gas passage 118 formed in an outer peripheral portion of the frame, flow around the electric motor 104 to cool this motor and move to the refrigerating circuit (FIG. 1) through the outlet 8.

At evaporation temperatures of −45° to −70° C., the drawn gas flow rate is reduced. In this embodiment, however, the electric motor 104 is sufficiently cooled since it is cooled by the refrigerant gas which is the sum of the drawn gas, the injected gas and the injected liquid. Also, in this embodiment, the drawn gas is directly drawn into the inlet chamber and the temperature of the discharged gas can be reduced by liquid injection so that the increase in the temperature of the compression section 102 is limited. There is therefore substantially no loss due to heating of the drawn gas. Also, the drawn gas flow rate is not reduced by gas injection. It is therefore possible to maintain a high volumetric efficiency of about 90% even at evaporation temperatures of −45° to −70° C. This effect has been confirmed by experiment. In this embodiment, wherein the geometrical shape of the wraps is determined so as to set an optimum compression ratio of 5, this high volumetric efficiency, the effect of the discharge valve 115 capable of limiting generation of unnecessary compressing power and so on make it possible to maintain a compression efficiency sufficient for practical use at evaporation temperatures of −45° to −70° C.

The refrigerator in which this scroll compressor is used will be described below with reference to FIGS. 1 and 2.

The refrigerant gas discharged through the outlet 8 of the scroll compressor 1 is condensed by the condenser 2. A part of the condensed liquid refrigerant is led to the liquid injection port 10 of the scroll compressor 1 through the liquid injection pipe 11 formed of a thin pipe. Another part of the liquid refrigerant is decompressed by the first decompressor 3 and is thereafter led to the liquid cooler 4. This part of refrigerant gas is gasified after cooling in the liquid cooler 4 the high pressure liquid refrigerant introduced into the second decompressor 5 and is led to the gas injection port 9 of the scroll compressor 1 through the pipe 12. The rest of the liquid refrigerant supercooled in the liquid cooler 4 is decompressed to a pressure corresponding to the evaporation temperatures of −45° to −70° C. by the second decompressor 5 provided as the main decompressor of the refrigerator, is introduced into the evaporator 6, and is led to the inlet 7 of the scroll compressor 1 after heat exchange in the evaporator.

The liquid refrigerant led to the liquid injection port 10 is not substantially decompressed since it is led from the outlet of the condenser 2. This part of liquid refrigerant can therefore be liquid-injected during compression through the liquid injection hole 112 opened at the point in time close to the end of the compression period. For this reason, the compressing power is not increased by the liquid injection. Conversely, the compression efficiency can be increased by the cooling effect of the liquid injection so that the required power is reduced. This effect has also been confirmed by experiment.

The gas injection holes 111 communicating with the gas injection port 9 are formed at positions such that they do not communicate with the suction hole 110 and that they are on the low pressure side. The injection rate can therefore be maximized while the pressure in the liquid cooler 4 can be minimized, so that the effect of supercooling of the liquid refrigerant led to the second decompressor is maximized. This supercooling effect enables an increase in the cooling capacity of the evaporator 6. This effect is apparent from the refrigerating cycle diagram of FIG. 2.

In accordance with the above-described embodiment, low temperatures determined by evaporation temperatures of −45° to −70° C., which are conventionally obtained by two-stage compression, can be obtained in a practical way by using a small single-stage scroll compressor in which a high pressure is produced in the sealed casing and in which the optimum compression ratio is small with respect to the actual operating pressure conditions, and by effecting liquid injection for cooling the electric motor and gas injection for achieving supercooling of the high pressure liquid refrigerant.

Figure 6:
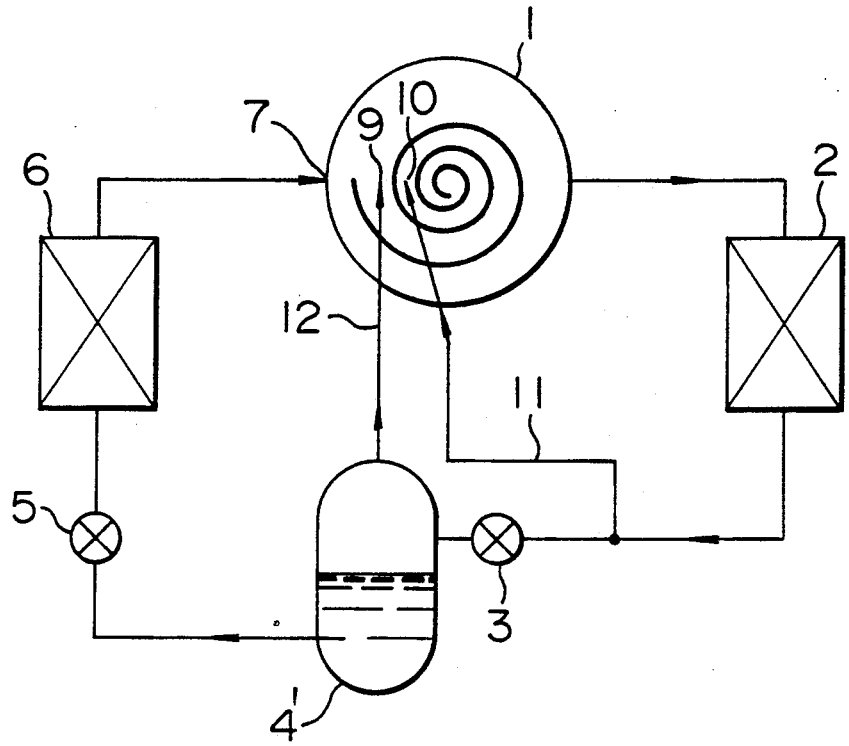
Figure 7:
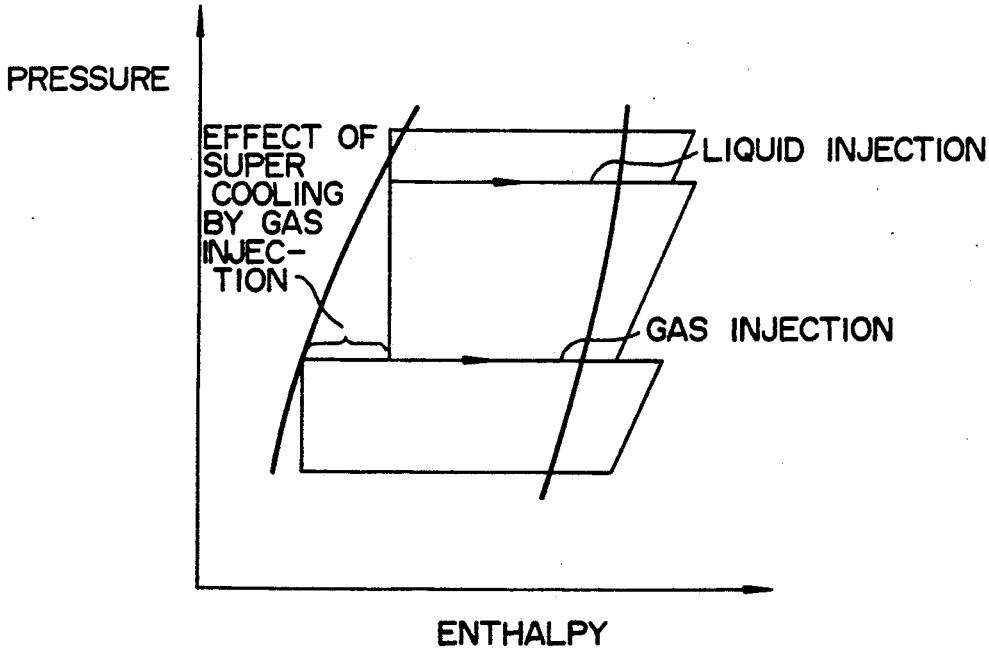

FIG. 6 shows a scroll refrigerator capable of operating at evaporation temperatures −45° to −70° C. in accordance with another embodiment of the present invention. This refrigerator has the same construction as that of the refrigerator shown in FIG. 1 except that a gas-liquid separator 4' is used as a high pressure liquid cooler, and that the liquid separated is introduced into the second decompressor 5. The corresponding components are indicated by the same reference numerals. In the operation of this embodiment, as shown in FIG. 6, supercooling of the high pressure liquid is effected by gas-liquid separation in the gas-liquid separator 4', while in the arrangement shown in FIG. 1 supercooling is effected by heat exchange in the liquid cooler 4. This embodiment operates in the same manner as the first embodiment except for this point. The effect of supercooling the high pressure liquid is apparent from the refrigerating cycle diagram of FIG. 7, and the refrigerating capacity can also be increased.

In the above-described embodiments, the geometrical shape of the wraps is determined so that the optimum compression ratio of the scroll compressor is 5 if Freon 22 is used. However, even in a case where the optimum compression ratio is smaller, it is possible to position the suction hole, the gas injection holes and the liquid injection hole so as to avoid any substantial communication therebetween. Although in this case the amount of unnecessary power is slightly increased, the volumetric efficiency is substantially equal to that of the above-described embodiments, and low temperatures determined by evaporation temperatures of −45° to −70° C. can be obtained. If the optimum compression ratio is larger than 5, the number of wrap turns (or wraps) is increased so that the size of the compressor is greater. In this case, however, the increase in the unnecessary power can be smaller in comparison with the described embodiments while the same low temperature can be obtained.

According to the present invention, as described above in detail, the provision of the gas injection holes and the liquid injection hole in the scroll compressor, in association with the structure in which the gas drawn into the scroll compressor is directly confined in the compression chamber, enables the electric motor and the compression section to be suitably cooled. It is thereby possible to obtain a scroll compressor capable of operating at evaporation temperatures of −45° to −70° C. without reducing the volumetric efficiency. If the capacity of drawn gas, the gas injection rate and the liquid injection rate are suitably adjusted without influencing each other, the above-mentioned effects can be further improved. A set volume ratio smaller than the theoretical optimum value is selected to reduce the size of the scroll compressor while maintaining the above-mentioned high volumetric efficiency. The amount of unnecessary power can be reduced by providing a discharge valve at the discharge hole of the stationary scroll. The consumption of unnecessary power with liquid injection can be prevented by effecting liquid injection at a point in time close to the end of the compression period. Consequently, the present invention achieves the same compression efficiency as the conventional two-stage compression system at evaporation temperatures of −45° to −70° C.

In the scroll refrigerator using the scroll compressor in accordance with the present invention, the scroll compressor can be cooled suitably by liquid injection, and supercooling of the high pressure liquid refrigerant can be achieved by gas injection, thereby enabling an increase in the refrigerating capacity at evaporation temperatures of −40° to −70° C.

According to the present invention, by the overall effects described above, low temperatures determined by evaporation temperatures of −45° to −70° C., which are conventionally obtained by a two-stage compression system, can be obtained by a small single-stage scroll compressor.

What is claimed is:

1. A scroll-type refrigerator comprising:

a scroll compressor including a stationary scroll and a revolving scroll, said stationary scroll having a gas suction hole formed in its radially outer portion, a gas discharge hole formed in its central portion, a gas injection hole and a liquid injection hole formed between said suction and discharge holes, said gas injection hole being formed in a radially outer portion of said stationary scroll, said liquid injection hole being formed in the vicinity of the central portion of said stationary scroll, and said liquid injection hole being opened at a point in time near an end of the compression period of operation of said compressor thereby allowing liquid refrigerant to be injected therethrough;

a condenser;

a first and second decompressors; and an evaporator, wherein said scroll compressor, said condenser, said decompressor and said evaporator are successively connected to form a refrigerating circuit, said liquid injection hole of said scroll compressor is directly connected by piping to an outlet of said condenser, and said gas injection hole of said scroll compressor is connected by piping to the outlet of said condenser through said first decompressor.

2. A scroll-type refrigerator according to claim 1, wherein the positional relationship between said holes of said scroll compressor is determined so that said holes do not communicate with each other.

3. A scroll type refrigerator according to claim 2, wherein said gas injection hole is connected to the outlet of said condenser through said first decompressor and a high-pressure liquid supercooler.

4. A scroll-type refrigerator according to claim 3, wherein said stationary scroll is provided with a discharge valve at said gas discharge hole.

5. A scroll-type refrigerator according to claim 3, wherein the gas and liquid injection holes of said stationary scroll are of a size having diameters smaller than the thickness of a wrap corresponding to said revolving scroll and are formed along surfaces of a wrap corresponding to said stationary scroll, said wraps have a shape corresponding to an involute curve.

6. A scroll-type refrigerator according to claim 5, wherein aid stationary scroll has two gas injection holes respectively formed on the low pressure side in substantially diametrically opposite and radially outer portions thereof.

7. A scroll-type refrigerator according to claim 6, wherein the involute curve of said stationary scroll has about four turns for providing an optimum compression ratio during compression of a refrigerant.

8. A scroll-type refrigerator according to claim 7, wherein said stationary scroll is provided with a discharge valve at said gas discharge hole.

9. A scroll-type refrigerator according to claim 1, wherein said gas injection hole is connected to the outlet of said condenser through said first decompressor and a high-pressure liquid supercooler.

10. A scroll-type refrigerator according to claim 9, wherein aid stationary scroll is provided with a discharge valve at said gas discharge hole.

11. A scroll compressor comprising:

a stationary scroll and a revolving scroll, said stationary scroll having a gas suction hole formed in its radially outer portion, a gas discharge hole formed in its central portion, a gas injection hole and a liquid injection hole formed between said suction and discharge holes, said gas injection hole being formed in a radially outer portion of said stationary scroll, said liquid injection hole being formed in the vicinity of the central portion of said stationary scroll, said liquid injection hole opening at a point in time near an end of the compression period of operation of said compressor thereby allowing liquid refrigerant to be injected therethrough;

wherein the positional relationship between said holes is determined so that said holes do not communicate with each other, and wherein said stationary scroll is provided with a discharge valve at said gas discharge hole.

12. A scroll compressor comprising:

a stationary scroll, and a revolving scroll, said stationary scroll having a gas suction hole formed in its radially outer portion, a gas discharge hole formed in its central portion, a gas injection hole and a liquid injection hole formed between said suction and discharge holes, said gas injection hole being formed in a radially outer portion of said stationary scroll, said liquid injection hole being formed in the vicinity of the central portion of said stationary scroll, and said liquid injection hole is opened at a point in time near an end of the compression period of operation of said compressor thereby allowing liquid refrigerant to be injected therethrough;

wherein the positional relationship between said holes is determined so that said holes do not communicate with each other, and wherein the gas and liquid injection holes are of a size having diameters smaller than the thickness of a wrap corresponding to said revolving scroll and are formed along surfaces of a wrap corresponding to said stationary scroll, said wraps having a shape corresponding to an involute curve.

13. A scroll compressor according to claim 12, wherein said stationary scroll has two gas injection holes respectively formed on the low pressure side in substantially diametrically opposite and radially outer portions thereof.

14. A scroll compressor according to claim 13, wherein the involute curve of said stationary scroll has about four turns for providing an optimum compression ratio during compression of a refrigerant.

* * * * *